United States Patent [19]

Young

[11] Patent Number: 4,565,241

[45] Date of Patent: Jan. 21, 1986

[54] PROCESS FOR PREPARING A SLURRY STRUCTURED METAL COMPOSITION

[75] Inventor: Kenneth P. Young, Ballwin, Mo.

[73] Assignee: International Telephone and Telegraph Corporation, New York, N.Y.

[21] Appl. No.: 383,812

[22] Filed: Jun. 1, 1982

[51] Int. Cl.[4] ..... B22D 27/02

[52] U.S. Cl. ..... 164/499; 164/71.1; 164/122; 164/900; 164/468; 420/590

[58] Field of Search ..... 164/900, 122, 71.1, 164/499, 468; 148/450; 420/590, 428

[56] References Cited

U.S. PATENT DOCUMENTS 4,434,837 3/1984 Winter et al. ..... 164/504

OTHER PUBLICATIONS

"Structure and Properties of Thixocast Steels", by Young et al., Metal Technology, p. 130, 4/1979.

*Primary Examiner*—Kuang Y. Lin

*Attorney, Agent, or Firm*—James B. Raden; Harold J. Holt

[57] ABSTRACT

A process for preparing a slurry structured metal composition comprising degenerate dendritic solid particles contained within a lower melting matrix composition, the process comprising vigorously agitating at a given shear rate molten metal as it is solidified. Greatly improved processing efficiencies result if the shear and solidification rates are adjusted so that the ratio of the shear rate to the solidification rate is maintained at a value ranging from $2\times10^3$ to $8\times10^3$.

3 Claims, No Drawings

PROCESS FOR PREPARING A SLURRY STRUCTURED METAL COMPOSITION

This invention relates to a process for preparing a metal composition and particularly a metal composition capable of subsequent shaping in a semi-solid condition.

The advantages of shaping metal in a partially solid, partially liquid condition have become well known. U.S. patents 3,902,544, 3,948,650 and 4,108,643 disclose a process for making possible such shaping processes by the prior vigorous agitation of a metal as it solidifies. This converts the normally dendritic microstructure of the metal into a non-dendritic form having a slurry structure, that is, one comprising discrete degenerate dendritic solid particles in a lower melting matrix. The principal means of agitation disclosed in the foregoing patents is mechanical. However agitation may also be accomplished by other means, as for example, magnetically. Copending U.S. application Ser. No. 15,250, filed Feb. 26, 1979, discloses a process for preparing a slurry structured metal alloy in which a stator surrounding the molten metal generates a rotating magnetic field across the solidification zone and causes the metal to rotate at a shear rate sufficient to shear dendrites as they are formed during solidification.

While the literature has heretofore indicated two of the critical parameters that must be selected to obtain the desired non-dendritic microstructure are shear rate and solidification rate, these parameters heretofore have been selected on an essentially empirical basis, based on the shear and solidification rates which generate as near perfect degenerate dendritic spheres as possible. On the other hand, the most efficient process would be one which produced the finest grain size at the highest solidifcation rates, and thus highest production throughput, and the lowest shear rates, and thus lowest energy input.

A primary object of the present invention is to provide a more efficient process for producing high quality slurry structured metal compositions.

An additional object of the invention is to provide a process for producing slurry structured metal compositions which compositions are especially adapted for shaping into final products while in a semi-solid condition.

It is still an additional object of this invention to provide a process for producing slurry structured metal compositions which may be formed or shaped more economically than has heretofore been possible.

I have now discovered that a unique relationship exists between shear rate and solidification rate, a relationship which is universally applicable to all slurry structured metal and metal alloy systems and that a single range of values can be used to specify acceptable operating limits for the ratio of shear rate to solidification rate. I have further discovered that slurry structured metal compositions produced in accordance with the invention have microstructure which combines the best forming or shaping characteristics and the most economical forming costs.

Specifically, the invention involves a process for preparing a slurry structured metal composition comprising degenerate dendritic solid particles contained within a lower melting matrix composition, the process comprising vigorously agitating at a given shear rate molten metal as it is solidified at a solidification rate such that, in the absence of agitation, a dendritic structure would be formed. During the preparation of the slurry structured composition, the solidification rate is adjusted so that the ratio of the shear rate to the solidification rate is maintained at a value ranging from $2\times10^3$ to $8\times10^3$.

In the preferred practice of the invention, the process comprises preparing a slurry structured composition by vigorously agitating at a given shear rate the metal in molten form as it solidifies at a solidification rate such that, in the absence of agitation, a dendritic structure would be formed, the ratio of the shear rate to the solidification rate being maintained at a value ranging from $2\times10^3$ to $8\times10^3$, completely solidifying the slurry structured composition, reheating the slurry structured composition to a semi-solid slurry having a volume fraction liquid ranging from 0.05 to 0.80 and shaping the reheated slurry to form a shaped metal part.

In order to understand the theoretical basis on which the invention is based, the following discussion will be helpful. If metal alloy systems were allowed to freeze under equilibrium conditions, the result would be a solid with perfect crystallographic orientation and a uniform composition as determined by the equilibrium phase diagram. In practice, however, such equilibrium conditions are seldom achieved. Dendrites grow as metals freeze because the metals are freezing under various degrees of non-equilibrium in which kinetic considerations, and particularly growth (or cooling) rate and temperature gradient, are important. The dendrites grow in the crystallographic direction which permits the most rapid transfer of the heat released at the liquid/solid interface and the branching of the dendrites represents an efficient means to distribute the solute.

The vigorous agitation of a metal or alloy as it freezes to convert the dendrites to a degenerate dendritic form is a dendrite fragmentation and coarsening process. A dendrite with its multiple branches has a very high surface to volume ratio and therefore a very high total surface energy. As in any other system, the tendency is to minimize total energy content and therefore, in this instance, to minimize surface area to volume ratio. This is the driving force which tends to give rise to dendrite coarsening, that is, the tendency to transform to a morphology which provides the minimum surface energy to volume ratio. The coarsening process is in direct competition with the freezing or solidification process which is causing the dendrite to form. Thus, alloys tend to have large dendrite arm spacings (are coarser) as the cooling rate (or solidification rate) decreases. In fact, a powerful metallurgical tool for the examination of cast structures is to measure the dendrite arm spacing and in so doing, determine an approximate cooling rate. Alloys which are cooled very rapidly have very small dendrite arm spacing and therefore very high surface to volume ratios. Alloys which are cooled slowly have coarser particles and thus a lower surface to volume ratio. The vigorous agitation of a metal as it freezes to produce a slurry cast structure is believed to accentuate the degree of liquid motion within the liquid-solid mixture and therefore force convection of the liquid around the mixture. This enhances the liquid phase transport, which is a key to the coarsening process. Thus, mixing or agitation accelerates the coarsening process.

Accordingly when mixing occurs as molten metal is cooled, the freezing process, which is the dendrite forming process, is competing with the coarsening process. The degree of coarsening can be approximately equated with the degree of agitation and an accurate measure of the latter is shear rate. Simply stated, I have found that the coarsening process must remove material from the extremities of the dendrite at about the same rate that the freezing process is causing it to form. The range of ratios necessary to achieve the desired balance between the two completing processes has been determined. This determination has been made experimentally by first determining the microstructure that produces the best forming characteristics, that is the slurry-type microstructure which is the most economically press forged or otherwise formed into a final product. The critical range of ratios of shear rate to freezing rate was then determined to produce that microstructrure. In the continuous preparation of slurry structured metal compositions, it is possible, as set forth in copending application Ser. No. 384,019, now Patent No. 4,482,012, filed on even date herewith to separate the slurry making portion of the process from final solidification. The present invention is intended to govern the shear and solidification relationship during the first portion of the process, i.e., during the preparation of the slurry structured composition.

The relationship of shear rate to solidification rate is expressed in the following ratio:

$$\frac{\dot{\gamma}}{\frac{(df/s)}{(dt)}}$$

in which $\gamma$ is shear rate sec. $^{-1}$ (reciprocal seconds), dfs is the delta (or change in) fraction solids (by volume), dt is delta (or change in) time and dfs/dt is solidification rate sec. $^{-1}$. Solidification rate is in fact the rate at which new solid is formed with respect to time, and should be equally applicable to all alloys, whether it be aluminum, copper, ferrous or other alloy systems. I have found that if this ratio is kept between the range $2\times10^3$ to $8\times10^3$ and preferably between the range $4\times10^3$ to $8\times10^3$, good quality shaped parts will be produced. If this ratio is allowed to fall below the minimum values, then unacceptably dendritic structures result leading to inconsistent and inhomogeneous flow and properties in the final shaping stage. Ratios in excess of the maximum require uneconomical power inputs to provide the required $\gamma$ or uneconomically low freezing rates. Also, beyond a certain high $\gamma$, turbulence and fluid cavitation is a processing problem, while low freezing rates result in very large grain sizes and poor resultant flow. The prior art has not heretofore recognized the significance of this ratio nor even the relationship of these two parameters. However, if ratios of shear rates and solidification rates taught by the prior art were calculated, they would be higher than this range. It has been found that this critical range of ratios applies to both mechanically stirred and magnetically stirred metals and is in fact dependent of the means or manner of agitation.

An acceptable microstructure has been defined as one capable of producing good quality shaped parts. By this is meant, a part which does not contain chemical segregation to the extent that major variations in performance will occur from region to region. The finer and more rounded the solid particles (degenerate dendrites), the better the performance in which forming operations as press forging, i.e., the more homogeneous the semi-solid flow. Variations in fraction solid which occurs in the shaped parts because of poor microstructure and consequent inhomogeneous flow is also indicative of a chemical difference which will affect such factors as corrosion, plateability, and mechanical performance. However, the present invention is also based, in part, on the discovery that it is unnecessary to generate as near perfect spheres as possible to obtain good quality shaped parts. The microstructure of the present compositions contains discrete degenerate dendritic particles which typically are substantially free of dendritic branches and approach a spherical shape. However, while the compositions are non-dendritic, the particles are less than perfect spheres. As used herein, the term slurry structured compositions is intended to identify metal compositions of the foregoing description, that is those having degenerate dendritic solid particles contained within a lower melting matrix composition.

In the preferred practice of the present invention, a predetermination is made of the microstructure of a shaped metal part having acceptable forming properties and good quality. This microstructure will normally depart from the theoretical, ideal microstructure set forth in the aforesaid U.S. patents 3,902,544, 3,948,650 and 4,108,643. After predetermining this microstructure, the metal or alloy is heated until it is substantially or entiely molten. The molten metal is then added to a heated mold equipped with agitation means which may be mechanical mixers of the type shown in U.S. patents 3,945,650, 3,902,544 and 4,108,643. Alternatively, the mold is equipped with magnetic stirring means of the type disclosed in the above referenced copending U.S. application Ser. No. 15,250, the disclosure of which is hereby incorporated by reference. The solidification rate is then measured and either the solidification rate, the shear rate or both are adjusted to fall within the foregoing range for the ratio of shear rate to solidification rate. The shear rate may range as low as 50 sec.$^{-1}$, but will normally fall from 500 sec. $^{-1}$ to 800 sec. $^{-1}$ or even higher. Any solidification rate may be used which, in the absence of agitation, would produce a dendrite structure. The specific value of the ratio of shear rate to solidification rate is selected by comparison of the microstructure of various ratios with that of the predetermined microstructure. After quenching, the resulting billet is reheated to a semi-solid slurry having a volume fraction liquid ranging from 0.05 to 0.80 and preferably not more than 0.35. The reheating completes the conversion of the microstructure to a nondendritic form, i.e., into discrete degenerate dendritic solid particles.

The reheated slurry structured compositions may be converted into finished parts by a variety of semi-solid forming or shaping operations including semi-solid extrusion, die casting and press forging. A preferred shaping process is the press forging process set forth in copending U.S. application Ser. No. 290,217, filed Aug. 5, 1981, the disclosure of which is hereby incorporated by reference. In that process, the metal charge is heated to the requisite partially solid, partially liquid temperature, placed in a die cavity and shaped under pressure. Both shaping and solidification times are extremely short and pressures are comparatively low.

The following example is illustrative of the practice of the invention. Unless otherwise indicated, all parts and percentages are by weight except for fraction solids which are by volume.

In a mechanical slurry maker of the type described in the aforementioned U.S. patent, 3,902,544, liquid aluminum alloy A356 of composition

| Si | Mi | Fe | Cu | Mn | Zn | Ti |
|---|---|---|---|---|---|---|
| 6.70 | 0.375 | 0.10 | 0.011 | .004 | 0.016 | 0.128 |

was charged at a temperature of 1250° F. The mixing rotor was then started spinning at 500 rpm and raised slowly so as to provide an annular exit port through which the alloy could discharge into a receiver. The position of the rotor was adjusted to provide an aluminum alloy discharge rate of 20 pounds/minute and the power to the heating coil was switched off such that the coil now functioned as a heat sink, cooling and discharging alloy as it passed through the mixing zone.

Small droplets of the alloy were quenched rapidly onto copper substrates and metallographically polished to reveal the microstructure. Volume fraction solid was estimated against known standards.

The average bulk solidification rate dfs/dt was then estimated using the following relationship:

$$\frac{dfs}{dt} = \frac{\text{volume fraction solid of quench sample } (fs)}{\text{time of passage through mixing zone } (dt)}$$

where $$dt = \frac{\text{volume capacity of mixing zone}}{\text{discharge flow rate of alloy}}$$

The average bulk cooling rate can be calculated as:

$$(T_{pour} = T_{exit})/dt \text{ °C./second}$$

and since $f_L = \phi^{-1/1-K}$ where $f_L$ is fraction liquid, K=equilibrium partition coefficient and $\phi$ is a dimensionless parameter $$\phi = \frac{T_M - T^{\#}}{T_M - T_L}$$

where $T_L$ is the alloy liquidus, T# is the exit temperature and $T_M$ is the melting point of the pure solvent metal. The bulk average cooling rate can be determined from the above formula.

The rotation of the mixing rotor was then adjusted to provide a shear rate such that $\gamma$/dfs/dt was $6\times10^3$. Eighteen pounds of this slurry was collected in a thin steel container and quenched and frozen by immersion into cold water. The resulting billet, approximately 6" diameter by 6" high, was then transferred to a stainless steel can and reheated by placing in a radiant furnance at a nominal temperature of 1200° F. to approximately 0.70 fraction solid (0.30 fraction liquid). The reheated billet was then formed into a wheel using the press forging procedure outlined in the aforesaid copending U.S. application Ser. No. 290,217.

I claim:

1. A process for preparing a shaped metal part from a slurry structured metal composition comprising degenerate dendritic solid particles contained within a lower melting matrix composition, said process comprising, preparing a slurry structured composition by vigorously agitating at a given shear rate the metal in molten form as it solidifies at a solidification rate such that, in the absence of agitation, a dendritic structure would be formed, the ratio of the shear rate to the solidification rate being maintained at a value ranging from $2\times10^3$ to $8\times10^3$, completely solidifying the slurry structured composition, reheating the slurry structured composition to a semi-solid slurry having a volume fraction liquid ranging from 0.05 to 0.80 and shaping the reheated slurry to form a shaped metal part.

2. The process of claim 1 in which the slurry structured composition is reheated to a volume fraction liquid of not more than 0.35.

3. The process of claim 1 in which the metal composition is an aluminum alloy.

* * * * *